US011572249B2

(12) United States Patent
Gargano

(10) Patent No.: US 11,572,249 B2
(45) Date of Patent: Feb. 7, 2023

(54) MODULAR CABLE REEL

(71) Applicant: Consolidated Edison Company of New York, Inc., New York, NY (US)

(72) Inventor: Michael V. Gargano, Bellmore, NY (US)

(73) Assignee: CONSOLIDATED EDISON COMPANY OF NEW YORK, INC., New York, NY (US)

( * ) Notice: Subject to any disclaimer, the term of this patent is extended or adjusted under 35 U.S.C. 154(b) by 94 days.

(21) Appl. No.: 16/997,411

(22) Filed: Aug. 19, 2020

(65) Prior Publication Data

US 2021/0053793 A1 Feb. 25, 2021

Related U.S. Application Data

(60) Provisional application No. 62/890,284, filed on Aug. 22, 2019.

(51) Int. Cl.
*B65H 75/44* (2006.01)

(52) U.S. Cl.
CPC ..... *B65H 75/4481* (2013.01); *B65H 2701/34* (2013.01)

(58) Field of Classification Search
CPC .... B65H 75/14; B65H 75/18; B65H 75/4481; B65H 2701/34; B66D 2700/0166
See application file for complete search history.

(56) References Cited

U.S. PATENT DOCUMENTS 1,608,972 A * 11/1926 Archer ..... B65H 75/14 242/118.7
1,733,598 A * 10/1929 Hubbard ..... B65H 75/14 242/118.6
2,590,623 A * 3/1952 Hulse, Jr. ..... B66D 1/26 254/284
2,822,952 A * 2/1958 Scott ..... B65D 21/0235 206/511
2,834,507 A * 5/1958 Metzler ..... B65D 85/672 206/509
2,928,623 A * 3/1960 Mayhew ..... B65H 75/14 242/118.8
3,039,226 A * 6/1962 Bagdonas ..... B65H 75/18 43/57.2
3,070,257 A * 12/1962 Bojanowski ..... B65D 21/0223 206/508
3,322,262 A * 5/1967 Puente ..... B65D 85/04 220/675
3,524,606 A 8/1970 Coski
3,635,421 A * 1/1972 Boland ..... B65H 75/22 57/18
3,726,396 A * 4/1973 Birkner ..... B65D 21/0209 53/409

(Continued)

*Primary Examiner* — Michael E Gallion
(74) *Attorney, Agent, or Firm* — Cantor Colburn LLP

(57) ABSTRACT

A system and method for collecting and storing different types of electrical cable is provided. The system includes a first cable reel comprising: a first wheel member; a second wheel member spaced apart from the first wheel member; a first inner wheel member disposed between the first wheel member and the second wheel member; a plurality of first gear members disposed on a first outer surface of the first wheel member; and a plurality of second gear members disposed on a second outer surface of the second wheel member.

8 Claims, 4 Drawing Sheets

(56) References Cited

U.S. PATENT DOCUMENTS 3,737,028 A * 6/1973 Carlson ..... B65D 85/672 53/409
3,989,142 A * 11/1976 Gwilliam, Jr. ..... B65D 43/0212 206/508
4,058,295 A * 11/1977 Morfitt ..... B66D 1/26 212/76
5,460,268 A 10/1995 Chenoweth
5,671,856 A * 9/1997 Lisch ..... B25H 3/06 220/4.27
6,715,710 B1 * 4/2004 Russell ..... B65H 75/18 242/605
7,954,748 B2 * 6/2011 Weissbrod ..... B65H 75/182 242/580
7,973,516 B2 7/2011 Flack
8,480,023 B2 * 7/2013 Penumatcha ..... B65H 75/14 242/604
9,042,701 B2 * 5/2015 Dagley ..... G02B 6/4457 385/136
9,126,800 B2 * 9/2015 Penumatcha ..... B65H 75/14
9,278,827 B2 * 3/2016 Niu ..... B65H 75/14
9,745,167 B2 * 8/2017 Niu ..... B65G 57/26
9,975,443 B2 * 5/2018 Jefferies ..... B60L 53/18
10,266,366 B2 * 4/2019 Galindo Gonzalez ..... B65H 75/30
10,343,871 B2 * 7/2019 Parke ..... G02B 6/4463
10,717,626 B2 * 7/2020 Kasahara ..... B65H 75/182
11,180,342 B2 * 11/2021 Kasahara ..... B65H 75/182
2009/0084887 A1 * 4/2009 Aiston ..... B65H 75/285 29/428
2009/0230228 A1 * 9/2009 Penumatcha ..... B65H 75/146 242/603
2013/0112930 A1 * 5/2013 Davis ..... B66D 1/46 254/264
2014/0056683 A1 * 2/2014 Niu ..... B65H 75/14 242/118.4
2014/0283664 A1 * 9/2014 Blette ..... B23P 19/00 242/600
2018/0170708 A1 * 6/2018 Kasahara ..... B65H 75/182
2019/0135593 A1 * 5/2019 Titus ..... B66D 1/30
2019/0276266 A1 * 9/2019 Nilsson ..... B65H 75/22

* cited by examiner

MODULAR CABLE REEL

CROSS REFERENCE TO RELATED APPLICATIONS

This application claims the benefit of U.S. Provisional Application Ser. No. 62/890,284, filed Aug. 22, 2019, the entire disclosure of which is incorporated herein by reference.

BACKGROUND

The subject matter disclosed herein relates to a cable reel, and in particular to a cable reel for electrical cable.

Electrical distribution systems utilize electrical conductors to transmit electricity from a generating source to an end customer or load. The electrical conductors are made from a metal, such as copper or aluminum for example. In the past, for high voltage applications, the conductors were a paper-insulated leaded sheathed cable type of cable (PILC). The PILC cables are hermetically sealed with a lead sheath, which protects the conductor against humidity and chemical contaminants (e.g. gasoline). The PILC cable is composed of a number of layers, some of which are impregnated with a high viscosity oil.

During routine maintenance and upgrade operations, utility personnel may remove older PILC cable and non-PILC cable. Cable that is removed from service is often recycled (e.g. sold as scrap). Due to the presence of oil and lead in the PILC cable, the value for PILC cable is much lower than non-PILC cable (e.g. <50% scrap value). When PILC cable and non-PILC cable is mixed on the same reel, the seller receives the lower value of the PILC cable for the whole reel.

Accordingly, while existing cable reels are suitable for their intended purposes the need for improvement remains, particularly in providing a cable reel system that allows for PILC cable and non-PILC cable to be collected without being intermingled.

BRIEF DESCRIPTION

According to one aspect of the disclosure, a system for collecting and storing different types of electrical cable is provided. The system includes a first cable reel comprising: a first wheel member; a second wheel member spaced apart from the first wheel member; a first inner wheel member disposed between the first wheel member and the second wheel member; a plurality of first gear members disposed on a first outer surface of the first wheel member; and a plurality of second gear members disposed on a second outer surface of the second wheel member.

In addition to one or more of the features described herein, or as an alternative, further embodiments of the system may include each of the plurality of first gear members being extended in a radial direction from an axis of rotation of the first cable reel. In addition to one or more of the features described herein, or as an alternative, further embodiments of the system may include a second cable reel, the second cable reel comprising: a third wheel member; a fourth wheel member spaced apart from the third wheel member; a second inner wheel member disposed between the third wheel member and the fourth wheel member; a plurality of third gear members disposed on a third outer surface of the third wheel member; a plurality of fourth gear members disposed on a fourth outer surface of the fourth wheel member; and wherein the third gear members are arranged to engage the second gear members when the second cable reel is disposed adjacent the first cable reel.

In addition to one or more of the features described herein, or as an alternative, further embodiments of the system may include the first inner wheel member being comprised of a plurality of inner wheel members coupled to each other. In addition to one or more of the features described herein, or as an alternative, further embodiments of the system may include a plurality of steel bands disposed about the plurality of inner wheel members. In addition to one or more of the features described herein, or as an alternative, further embodiments of the system may include the first wheel member includes a first coaxial opening, and the second wheel member includes a second coaxial opening.

In addition to one or more of the features described herein, or as an alternative, further embodiments of the system may include a first cross member coupled on each end to the first wheel member, the first cross member extending across the first coaxial opening; a second cross member coupled on each end to the first wheel member, the second cross member extending across the first coaxial opening, the second cross member being disposed perpendicular to the first cross member; and wherein the first cross member and second cross member each include an opening, the opening defining an axis of rotation for the first cable reel.

In addition to one or more of the features described herein, or as an alternative, further embodiments of the system may include a distance between the first outer surface and the second outer surface is 30 inches. In addition to one or more of the features described herein, or as an alternative, further embodiments of the system may include the first wheel and the second wheel having a diameter of 96 inches. In addition to one or more of the features described herein, or as an alternative, further embodiments of the system may include the first inner wheel having a diameter of 43 inches.

According to another aspect of the disclosure a method of collecting electrical conductors is provided. The method including providing a first cable reel, the first reel member having a pair of first wheel members coupled by a first inner wheel, each of the pair of first wheel members having a plurality of first gear members disposed on outer surfaces of the pair of first wheel members. A second cable reel is provided having a pair of second wheel members coupled by a second inner wheel, each of the pair of second wheel members having a plurality of second gear members disposed on outer surfaces of the pair of second wheel members. The second reel member is disposed adjacent the first reel member. The first gear members with the second gear members are engaged. The first cable reel and second cable reel being rotatable about a common axis of rotation when the first gear members are coupled to the second gear members.

In addition to one or more of the features described herein, or as an alternative, further embodiments of the method may include coupling a first electrical conductor to the first inner wheel and rotating the first cable reel and second cable reel to wrap the first electrical conductor about the first inner wheel. In addition to one or more of the features described herein, or as an alternative, further embodiments of the method may include coupling a second electrical conductor to the second inner wheel and rotating the first cable reel and second cable reel to wrap the second electrical conductor about the second inner wheel.

In addition to one or more of the features described herein, or as an alternative, further embodiments of the method may include the first electrical conductor being a PILC type electrical conductor. In addition to one or more of the features described herein, or as an alternative, further embodiments of the method may include the first electrical conductor being a non-PILC type electrical conductor.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments of the present disclosure provide for a cable reel system that allows for multiple cable reels to be coupled in a modular fashion, for use on an electrical utility vehicle, such as a cable pull truck. This provides advantages in all the utility personnel to pull or collect multiple types of electrical conductors that are segregated from each other. This further provides advantages in that the individual cable reels may be separated from each other, such as when the vehicle returns to the utility depot for example, for further down stream processing, such as recycling for example.

Figure 1:
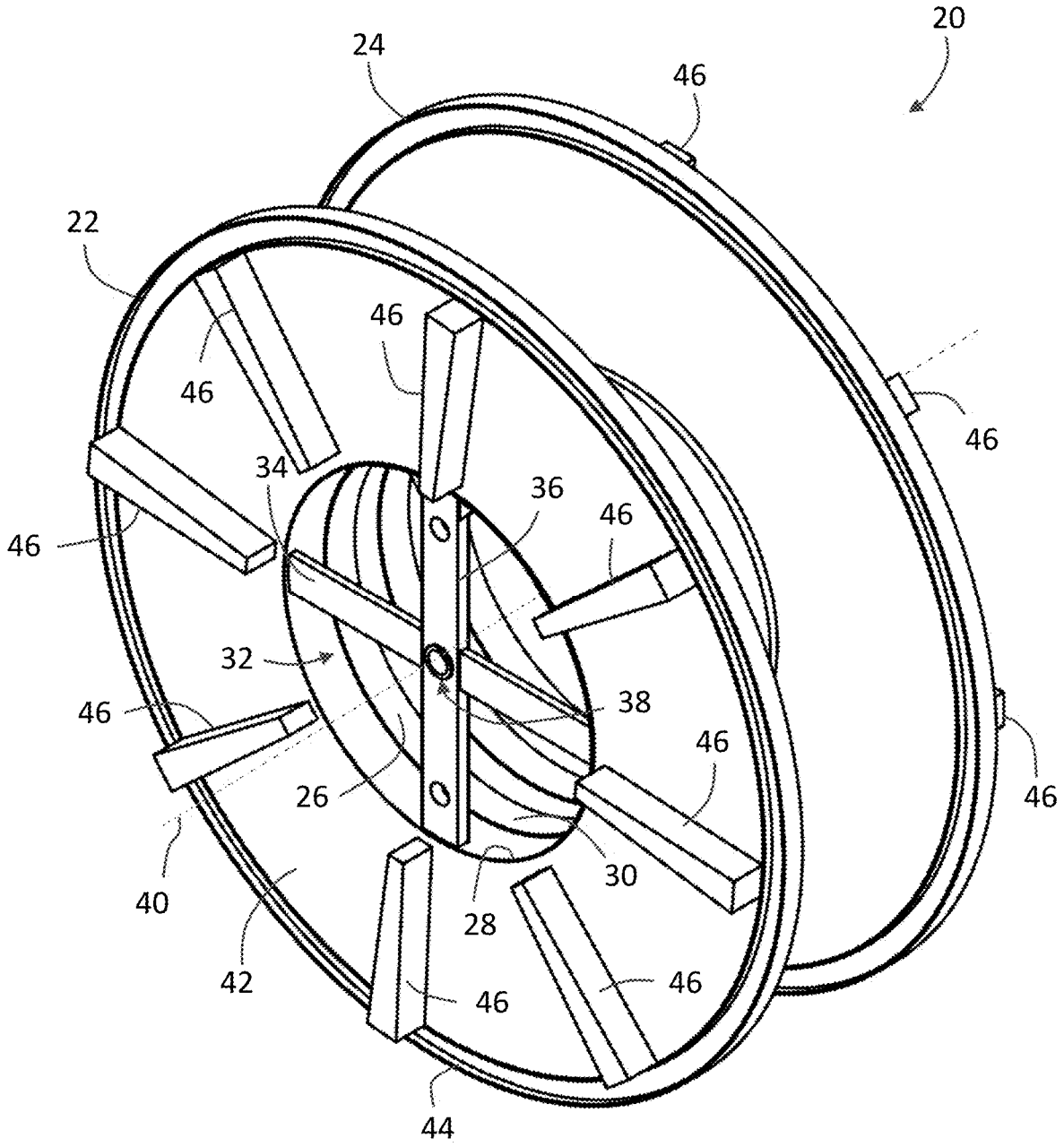
FIG. 1 is a perspective view of a single cable reel for collecting and storing cable in accordance with an embodiment.
Figure 2:
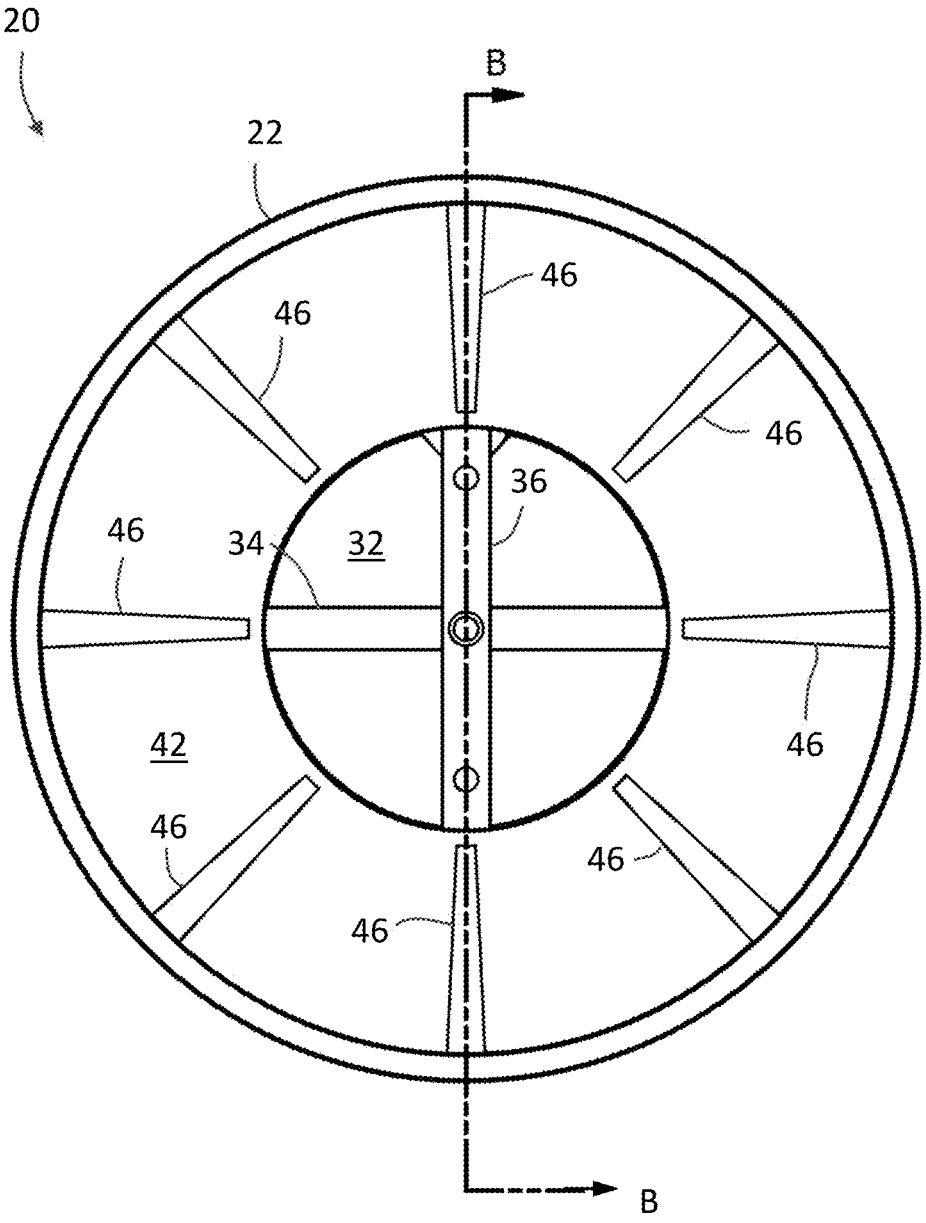
FIG. 2 is a side view of the cable reel of FIG. 1.
Figure 3:
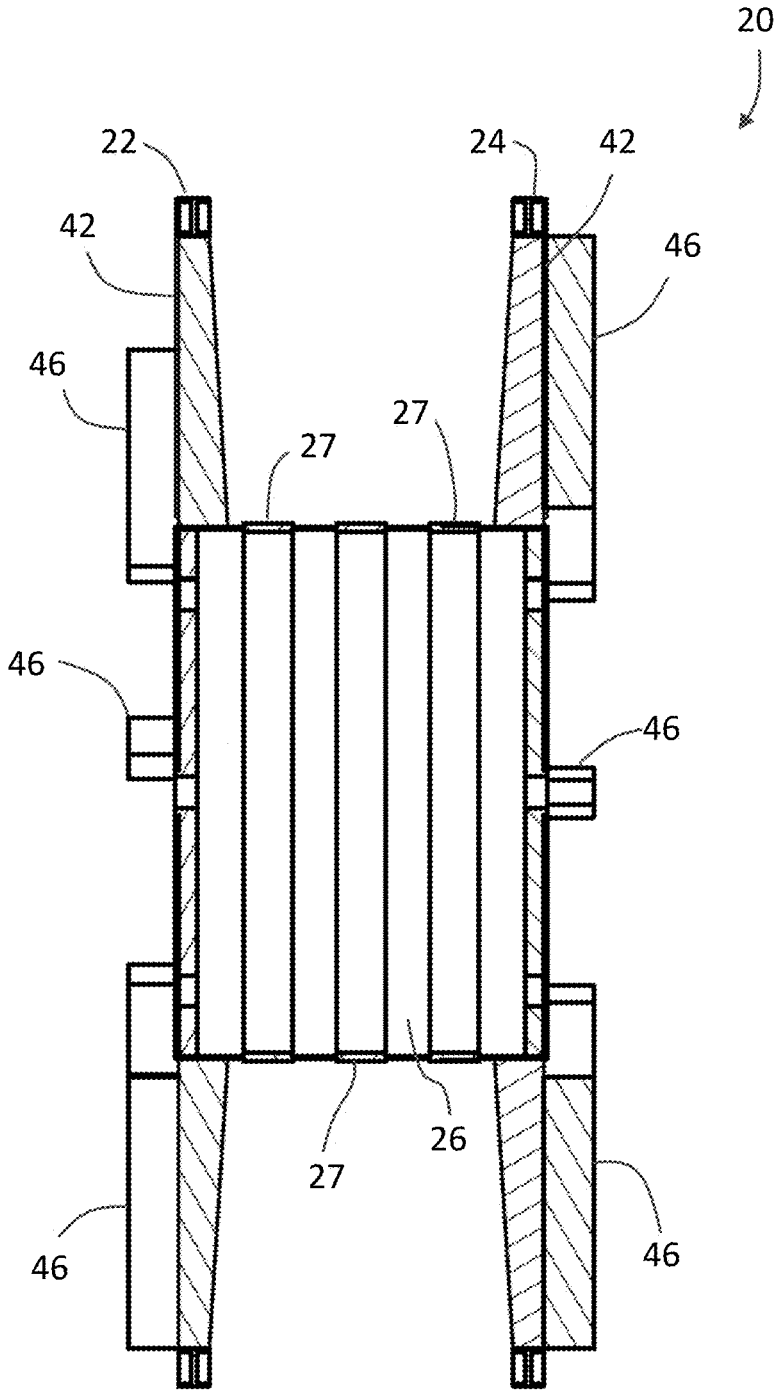
FIG. 3 is a sectional view along the line B-B of FIG. 2.

Referring now to FIGS. 1-3, an embodiment is shown of a cable reel 20. The cable reel 20 includes a first wheel member 22 and a second wheel member 24 that are spaced apart from each other. In the illustrated embodiment, the wheel members 22, 24 are coupled together by an inner wheel member 26. In the illustrated embodiment, the inner wheel member 26 is formed from a plurality of inner wheel members that are formed in a ring shape and coupled together in a laminate manner to form the inner wheel member 26. In an embodiment, the inner wheel member 26 may be supported by one or more steel bands 27 (FIG. 3). The wheel members 22, 24 and the inner wheel member 26 each have an inner diameter 28, 30 that defines a central opening 32.

Coupled to the inner diameter 28 of the wheel members 22, 24 are a pair of cross members 34, 36. In an embodiment, the cross member 36 extends across the opening 32 such that both ends of the cross member 36 are coupled to the inner diameter 28 of the respective wheel member 22, 24. The cross member 36 includes an opening 38 disposed centrally thereon. The opening 38 and the corresponding opening in the opposing cross member receive an axle (not shown) on the utility vehicle that allows the cable reel 20 to rotate about the axis 40.

Each wheel member 22, 24 is circular in shape and includes an outer surface 42. In an embodiment, a lip 44 extends about the periphery of the outer surface 42. As used herein, the surface 42 is the outer surface when it faces a direction away from the opposing wheel member. In accordance with an embodiment, a plurality of gear members 46 are disposed on the outer surface 42. The plurality of gear members 46 have a generally elongated shape that extends radially relative to the axis 40. In an embodiment, each of the plurality of gear members 46 has an isosceles trapezoidal shape with the shorter length edge being located closer to the axis 40 than the longer length edge. In an embodiment, the legs or lateral sides of the trapezoid are angled such that if the sides were extended, they would intersect proximate to, or coincident with, the axis 40.

Figure 4:
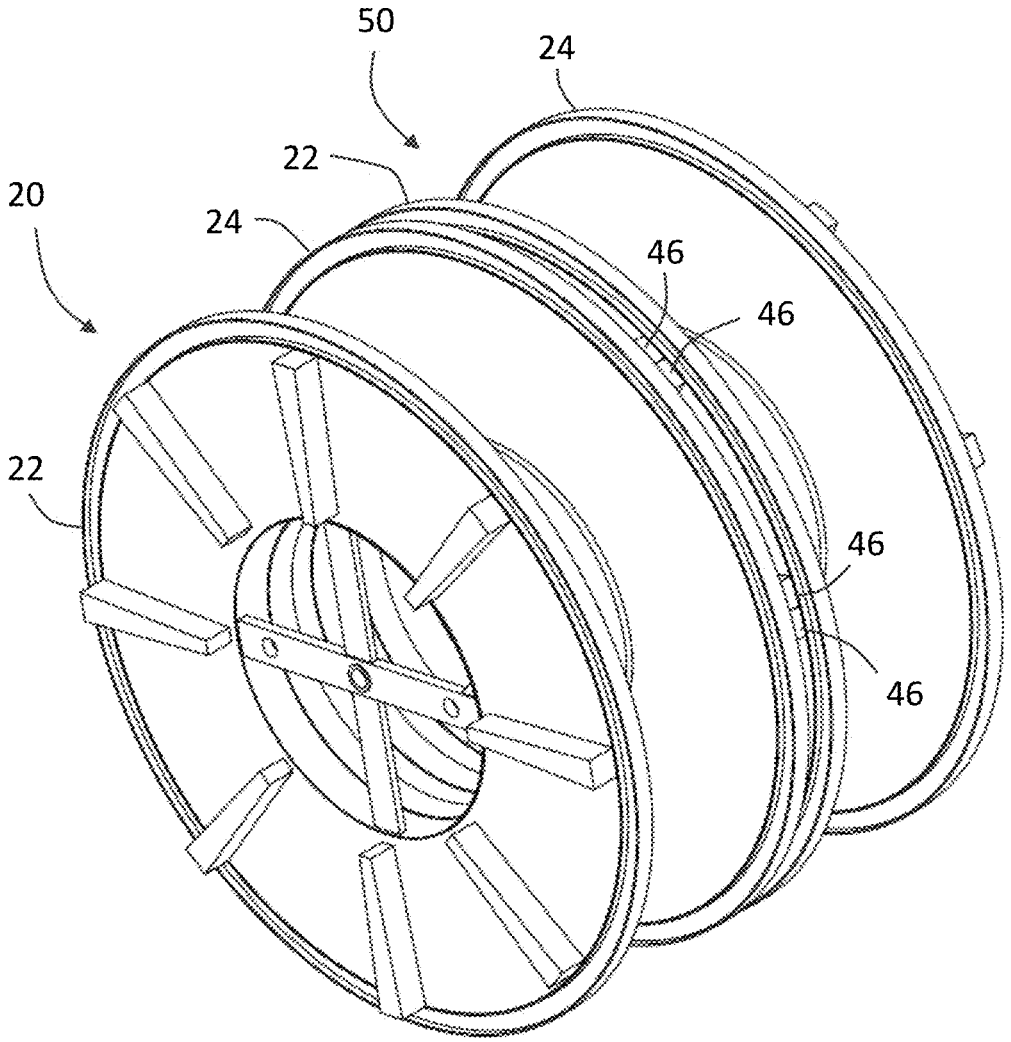
FIG. 4 is a perspective view of a pair of interlocked cable reels in accordance with an embodiment.

In an embodiment, the plurality of gear members 46 are disposed equidistant, or equiangularly, apart about the axis 40. In an embodiment, the plurality of gear members 46 includes eight gear members. In an embodiment, the gear members 46 are 45 degrees apart. In an embodiment, the gear members 46 on the first wheel member 22 are aligned, or are substantially aligned, with the gear members 46 on the second wheel member 24. The gear members 46 are configured to engage with corresponding gear members on an adjacent cable reel 50 when the two cable reels are installed on the same axle (not shown) as is shown in FIG. 4. It should be appreciated that when the gear members of adjacent cable reels 20, 50 are engaged, when the driving system (not shown) of the cable reel is activated, both cable reels will rotate together.

In an embodiment, the distance between the outer surfaces of the wheel members 22, 24 is 30 inches. In an embodiment, the wheel members 22, 24 have an outer diameter of 96 inches. In an embodiment, the inner diameter is 43 inches.

In operation, when utility personnel are performing operations that may involve more than one type of electrical conductor (e.g. both PILC and non-PILC conductors), the utility personnel will install two (or more) cable reels on the vehicle. It should be appreciated that while embodiments herein may refer to two cable reels, this is for example purposes and the claims should not be so limited. In other embodiments, the system may include three, four or more cable reels.

With the cable reels installed on the utility vehicle, the gear members of the respective cable reels will be engaged such that the cable reels will rotate together. It should be appreciated that this allows the cable reel system to be used on existing utility vehicles and be compatible with the reel drive system of the vehicle. The utility personnel then proceed to the location where the existing electrical conductor will be taken out of service. The utility personnel identify the type of electrical conductor (PILC or non-PILC) is being collected and attaches an end to one of the cable reels 20, 50. The drive system is activated, and the electrical conductor is removed from service and wrapped around the cable reel as is known in the art. If during the course of collecting the electrical cable the type of cable changes, or if the utility personnel otherwise start to collect a different type of cable, the utility personnel connect the new cable to the other cable reel 20, 50. In this way, the different types of cable are segregated from each other as the cable is collected.

In an embodiment, once the utility personnel have completed collecting the electrical conductor(s), the utility vehicle is moved back to a utility location, such as a central depot, and the cable reels 20, 50 are unloaded from the utility vehicle. The respective cable reels 20, 50 may then be separated and stored with other cable reels of the same type. In this way, when the utility recycles or sells the scrap electrical conductors, they may receive an improved price since the electrical conductors are not comingled.

It should be appreciated that while embodiments herein refer to a "utility" or "utility personnel", this is for example purposes and the claims should not be so limited. In other embodiments, non-utility personnel or other entities may be collecting the electrical conductors.

The term "about" is intended to include the degree of error associated with measurement of the particular quantity based upon the equipment available at the time of filing the application.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A system for collecting and storing different types of electrical cable, the system comprising:

a first cable reel comprising:

a first wheel member;

a second wheel member spaced apart from the first wheel member;

a first inner wheel member disposed between the first wheel member and the second wheel member;

a plurality of first gear members disposed on a first outer surface of the first wheel member;

a plurality of second gear members disposed on a second outer surface of the second wheel member;

wherein the first wheel member includes a first coaxial opening, and the second wheel member includes a second coaxial opening; and a first cross member coupled on each end to the first wheel member, the first cross member extending across the first coaxial opening;

a second cross member coupled on each end to the first wheel member, the second cross member extending across the first coaxial opening, the second cross member being disposed perpendicular to the first cross member; and wherein the first cross member and the second cross member each include an opening, the opening defining an axis of rotation for the first cable reel.

2. The system of claim 1, wherein each of the plurality of first gear members extend in a radial direction from an axis of rotation of the first cable reel.

3. The system of claim 1, further comprising a second cable reel, the second cable reel comprising:

a third wheel member;

a fourth wheel member spaced apart from the third wheel member;

a second inner wheel member disposed between the third wheel member and the fourth wheel member;

a plurality of third gear members disposed on a third outer surface of the third wheel member, wherein each of the plurality of third gear members having an elongated shape and extending radially relative to an axis of rotation of the third wheel;

a plurality of fourth gear members disposed on a fourth outer surface of the fourth wheel member, wherein each of the plurality of fourth gear members having an elongated shape and extending radially relative to an axis of rotation of the fourth wheel; and wherein the plurality of third gear members are arranged to engage the plurality of second gear members when the second cable reel is disposed adjacent the first cable reel.

4. The system of claim 1, wherein the first inner wheel member is comprised of a plurality of inner wheel members coupled to each other.

5. The system of claim 4, further comprising a plurality of steel bands disposed about the plurality of inner wheel members.

6. The system of claim 1, wherein a distance between the first outer surface and the second outer surface is 30 inches.

7. The system of claim 6, wherein the first wheel member and the second wheel member have an outer diameter of 96 inches.

8. The system of claim 7, wherein an inner diameter of the first wheel member is 43 inches.

* * * * *